US005548469A

United States Patent [19]

Adams

[11] Patent Number: 5,548,469

[45] Date of Patent: Aug. 20, 1996

[54] MULTI-PATH STATIC CONTROL GARMENT AND WRIST STRAP COMBINATION

[75] Inventor: Kay L. Adams, Carlsbad, Calif.

[73] Assignee: Tech Wear, Inc., Carlsbad, Calif.

[21] Appl. No.: 431,265

[22] Filed: Apr. 28, 1995

Related U.S. Application Data

[63] Continuation-in-part of Ser. No. 191,625, Feb. 4, 1994, Pat. No. 5,440,444.

[51] Int. Cl.[6] ..... H05F 03/02

[52] U.S. Cl. ..... 361/220; 361/212

[58] Field of Search ..... 361/212, 220, 361/223, 224; 2/1, 51, 901, 902; 57/901

[56] References Cited

U.S. PATENT DOCUMENTS 5,440,444 8/1995 Adams ..... 361/220

*Primary Examiner*—Fritz M. Fleming
*Attorney, Agent, or Firm*—Richard L. Gausewitz

[57] ABSTRACT

A static electricity control combination including an electrically conductive smock and a dual-contact wrist strap. It further comprises an elongate insulated flexible conductor that is sewn along one sleeve and along the body of the smock. A first grounding path extends from the wrist strap to the insulated flexible conductor and thus to a first contact on the body and to ground. A second grounding path extends from the wrist strap to the sleeve and body to a second contact on the body and to ground.

20 Claims, 2 Drawing Sheets

FIG. 3.
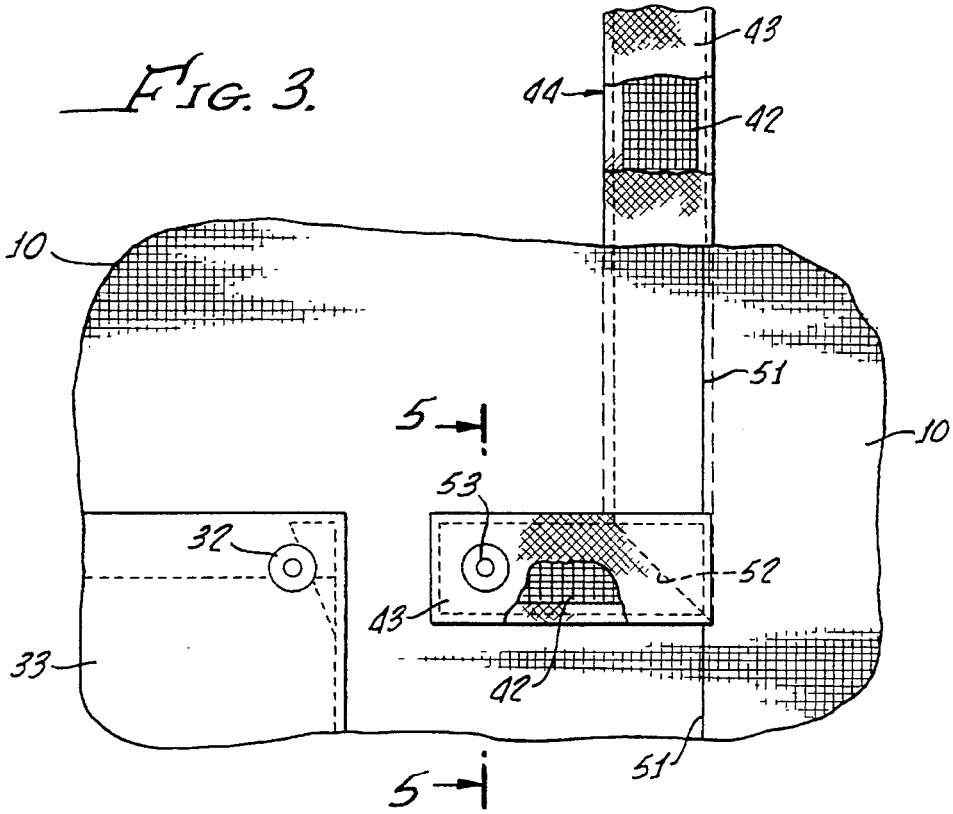
FIG. 4.
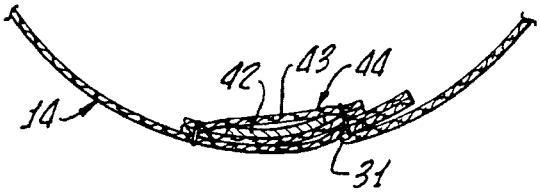
FIG. 5.
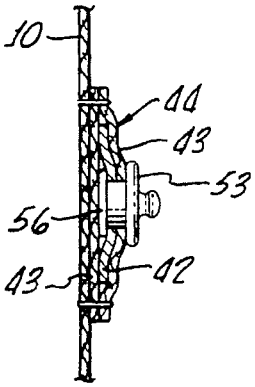
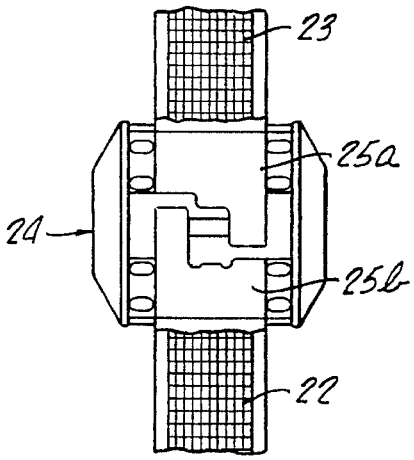
FIG. 6.

MULTI-PATH STATIC CONTROL GARMENT AND WRIST STRAP COMBINATION

This application is a continuation-in-part of U.S. patent application Ser. No. 08/191,625, filed Feb. 4, 1994, for a MULTI-PATH STATIC CONTROL GARMENT.

BACKGROUND OF THE INVENTION

In the copending U.S. patent application 191,625, there is shown and described a garment having cuffs and having separate grounding paths. There is no wrist strap.

There are, in the field of static control garments, applications that require a wrist strap to be worn; for example, where a wrist strap is designated by the customer as the body contacting mechanism for a dual-path ground. Some companies require that the contact with the wrist strap be metal to the body. An example of the latter wrist strap is in the nature of a "Speidel" watchband. There are also fabric-type wrist straps that have two metal plates as conductive body-contact elements.

The stated metal-to-the-body requirement would be a difficult requirement to comply with in a garment, especially one made of a soft textile (fabric) material. The metal would have to be permanently attached to the fabric, and this means that the metal would be laundered under the same washing conditions required for laundering of the garment. The result could be a problem relative to metal deterioration caused by such factors as corrosion, or coating of the metal with an insulator. Build-up of insulator could be caused on the metal by soaps and washing chemicals.

Until now, a wrist strap having two isolated body contact points, and directly contacted to a dual-wire cord leading directly to the ground, has been the only way to satisfy the metal-to-the-body requirement in a redundant dual-path monitoring system. But direct connection from wrist strap to ground has at least one disadvantage, and at least one nonadvantage. The disadvantage is that the wrist is tethered-which can be an annoying and efficiency-reducing thing. The nonadvantage is that there is no "Faraday cage" (Faraday cage-like) action such as is described below.

SUMMARY OF THE INVENTION

An object of the present invention is to provide a multiple-path Faraday cage garment that, at its body portion, is connected by separate paths to ground and that, at its sleeve hem portion, is connected by separate paths through a wrist strap into contact with the wearer's wrist.

Another object of the present invention is to provide a wrist strap-type double grounding system in which there is combination flexible cloth insulation and a conductive ribbon within the garment.

Another object of the present invention is to provide a wrist strap-type double grounding system in which the double connection from the wrist strap to the sleeve hem interferes only minimally, if at all, with movements of the hand of the operator.

In carrying out principles of the present invention in accordance with the preferred embodiment thereof, a multipath static control garment comprises an electrically conductive body section and first and second electrically conductive sleeve sections. First and second electrically conductive body contact means connected to one of the sleeve sections are adapted to contact an arm of the wearer of the garment, such body contact means being in a wrist strap. The first body contact means is connected through the garment to a first grounding terminal on the garment body section. The second body contact means is connected through an independent grounding path to a second grounding terminal on the body section. Such second terminal is insulated from the garment.

Thus, the garment-wrist strap combination comprises two separate, independent and mutually isolated grounding paths to first and second mutually insulated grounding terminals on the body section, and including a wrist strap connected to the garment, thereby achieving an improved redundant grounding of the wearer.

BRIEF DESCRIPTION OF THE DRAWINGS

FIG. 3 is an enlarged fragmentary front elevational and side elevational view of the contact region and a connector region of the body of the garment;

FIG. 4 is a fragmentary enlarged cross-sectional view of the left sleeve and associated insulating and conductive fabric;

FIG. 5 is an enlarged section on line 5—5 of FIG. 3; and

FIG. 6 is a view of the skin-contact side of the contact element of the wrist strap.

DETAILED DESCRIPTION OF THE PREFERRED EMBODIMENT

Said U.S. patent application Ser. No. 08/191,625, for MULTI-PATH STATIC CONTROL GARMENT, filed Feb. 4, 1994, Inventor Kay L. Adams, is hereby incorporated by reference herein.

Figure 1:
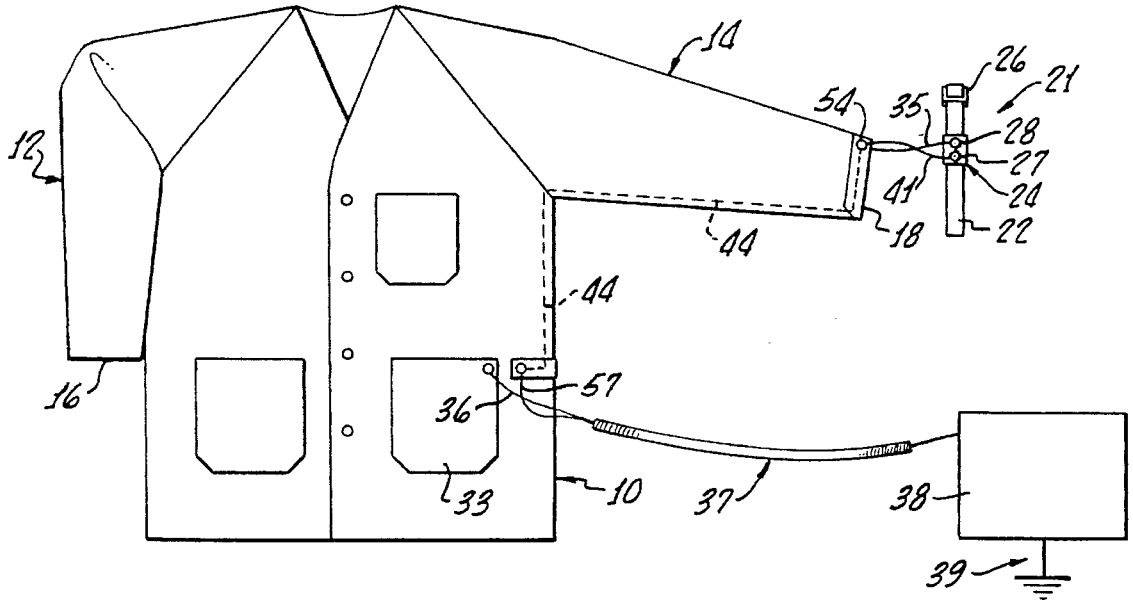
FIG. 1 is a schematic view, in front elevation, showing the combination garment, dual wrist strap, and dual grounding circuitry of the present invention.

The garment illustrated in FIG. 1 of the present patent application is in the form of a smock or a shop jacket of generally knee or mid-thigh length, having a metal snap front that can be opened and closed. This particular style of garment is shown solely for purposes of illustration, since the shape and style of the garment can vary without departing from principles of the present invention.

The garment includes a body section 10, and sleeve sections 12, 14 that terminate in hems 16, 18, respectively. All of the garment is made of a knit (or woven) fabric or cloth having knit therein an electrically conductive Faraday cage grid. In a presently preferred example, the garment is knit of 89% polyester having 11% of carbon-suffused monofilament nylon knitted into a conductive grid pattern therein. Such grid is formed of a monofilament nylon that is suffused with carbon to provide electrically conductive carbon fibers throughout the entire body section and sleeve sections of the garment. The knit carbon suffused grid has squares of approximately ⅛ to ¼ inch size. The grid defines a Faraday cage shield to shield the components being worked on from any radiation of static electricity off the wearer's regular clothing, since the illustrated garment is generally worn over the wearer's regular clothing.

The words "hem" and "hems" as used in this application denote any type of outer end of either sleeve, except only cuffs that engage the skin and are electrically conductive as set forth in the above-cited copending patent application. In the preferred form, the cloth is reverse-bent and sewn into a conventional hem (FIG. 2), but there are other types of sleeve ends that could be used. These include sleeve ends having multiple stitching with or without reinforcement (reinforcing layers). The Dual Grounding Path Includinq Wrist Strap and Garment Various types of dual-path wrist straps may be used, for example, as shown and described in U.S. Pat. No. 4,639,825 which is incorporated by reference herein.

Figure 2:
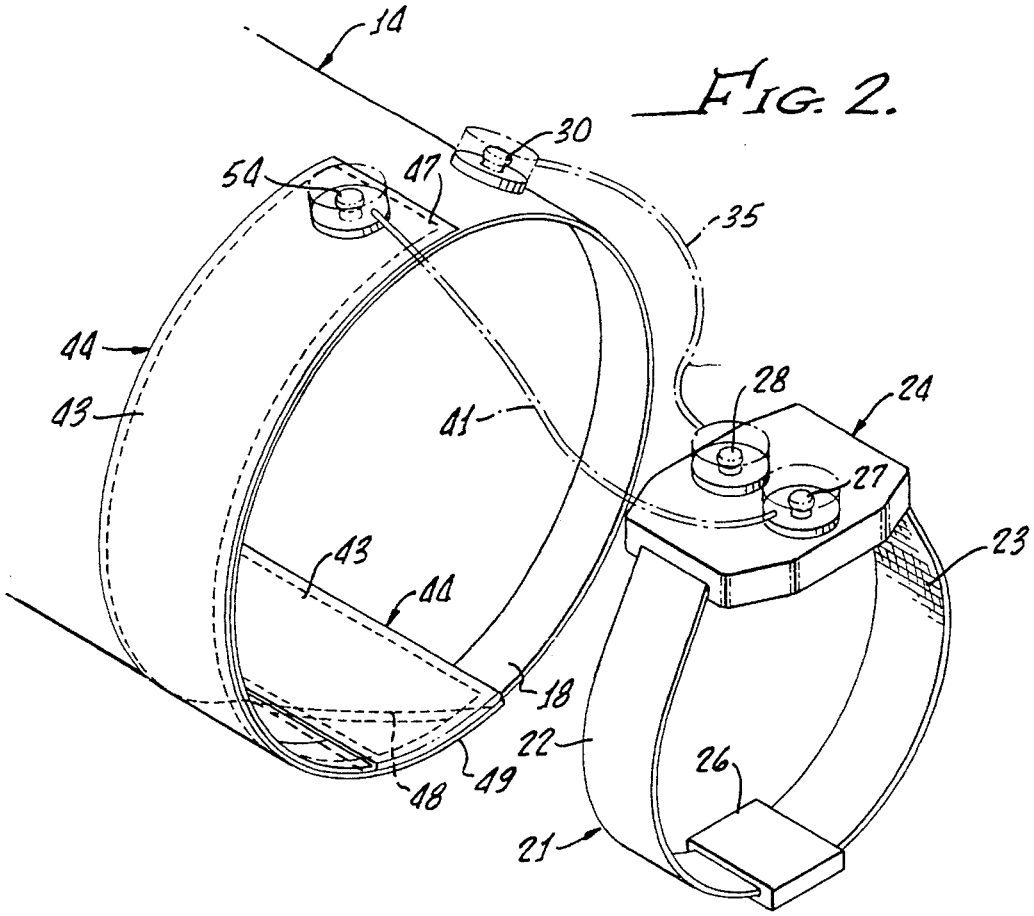
FIG. 2 is a view of the left wrist portion of the garment of FIG. 1, and of the wrist strap of FIG. 1.

The wrist strap shown in FIG. 2 and FIG. 6 hereof, and numbered 21, has two stretchable (for example, knit) cloth sections 22, 23. Each such section 22, 23 is electrically conductive on its inside surface, so as to provide contact with the wrist of the wearer, but is insulating on its outer surface. Sections 22, 23 do not electrically connect to each other; instead, each extends between a contact element 24 and a length-adjustment mechanism or buckle 26. The contact element and the buckle are each formed of insulating synthetic resin so as to electrically isolate sections 22, 23 from each other.

As shown by FIG. 6, contact element 24 has metal plates 25*a*, 25*b* on the inner side thereof—for direct contact with the skin of the wearer's wrist. Plate 25*a* connects electrically to strap section 23. Plate 25*b* connects electrically to strap section 22. The plates are insulated from each other.

A metal stud 27 (FIG. 2), part of a snap connector, is provided on contact element 24 and electrically connected to plate 25*b* and to cloth section 22. A second metal stud or snap connector 28 on element 24 is electrically connected to plate 25a and to cloth section 23.

A metal stud 30, part of a snap connector, is mounted on hem 18 of sleeve 14, at the upper side of such sleeve (FIG. 2). Stated otherwise, connector 30 is mounted on hem 18 at a region generally opposite the underside of sleeve 14, such underside having a longitudinal seam 31 sewn therein as shown in FIG. 4.

Another stud, part of a metal snap connector, and numbered 32, is mounted on the body 10 of the garment, as best shown in FIG. 3. The preferred location is the upper-outer corner of the pocket 33 of a garment. Preferably, the pocket 33 is the lower-left pocket of the garment.

An insulated flexible wire 35, having a female portion of the metal snap connector at each end (FIG. 2), is snap-connected between stud 28 on wrist strap 21 and stud 30 on hem 18. A second insulated flexible wire, numbered 36 (FIG. 1), is snap-connected between stud 32 and ground. Stated more definitely, wire 36 forms part of a dual grounding cord 37 (FIG. 1) that extends from the body of the garment to circuit elements 38 and thence to ground 39. Ground 39 may be (for example) an electrically conductive clamp that is secured to a metal pipe (or other grounding element) in the structure. Circuit elements 38 are indicated by a box, reference being made to the above-cited U.S. Pat. No. 4,639,825.

There is, accordingly, a first grounding path that extends from wrist strap section 23 and metal plate 25*a* through connector (stud) 28 and wire 35 to connector 30, and thence through the sleeve 14 to the body 10 of the garment, and thence through various paths in such body 10 to connector 32 and wire 36 to circuit elements 38 and ground 39. In addition, static electricity passes directly from the regular clothing of the wearer of the smock to the Faraday cage contained within the smock or shop coat, and thence through wire 36 to ground.

There is contact to the wrist of the wearer at the inner portion of cloth section 23, and metal-to-skin contact to the wrist of the wearer through metal contact element 25*a*.

Proceeding next to a description of the second of the dual grounding paths, this includes the section 22 of wrist strap 21, and the metal plate 25*b* on the underside of contact element 24, both of which connect electrically to a metal stud (part of a snap connector) 27 on the contact element 24. Connector 27 connects through a second insulated flexible wire, numbered 41, which wire connects electrically to a stud (part of a snap connector) 54 mounted on hem 18 of sleeve 14 but not electrically connected to such hem (or to any part of the sleeve). (It is to be understood that the insulated flexible wires 35, 41 may be secured to each other longitudinally into a single cord having two mutually-insulated sections.)

There will next be described the portion of the second grounding path that is in the garment, and that provides comfortable and minimally-annoying locations for connection to wrist strap 21 and to the dual grounding cord 37.

A long, flexible, electrically conductive ribbon 42 is provided, and at all portions thereof is enclosed in an insulating sheath 43 (FIGS. 2 and 3). The construction is such that opposite sides of sheath 43 sandwich the conductive ribbon 42 between them. The sheath is secured, namely, sewn, to the garment by nonconductive thread.

Insulating sheath 43 is a cloth—for example, a cloth binding material—made of nonconductive cotton or the like. The conductive ribbon 42 and its sheath 43 combine to form an elongate, washable, flexible, sewable insulated electrical conductor, which is numbered 44.

One end of such conductor 44 is sewn to the exterior of hem 18 on sleeve 14, by nonconductive thread, such end being numbered 47. End 47 is on the upper portion of sleeve 14, generally opposite the seam of such sleeve 14—which seam is along the underside of the sleeve. End 47 is spaced a short distance from the above-indicated metal stud (snap connector) 30.

From end 47, conductor 44 is sewn around the exterior of hem 18 at the forward side thereof (when the sleeve 14 projects as shown in FIG. 1), being parallel to the extreme outer edge of hem 18.

At a region adjacent the bottom seam 31 of sleeve 14, the flexible electrical conductor 44 is bent underneath itself, outwardly, in a hospital corner (the angled edge of which is numbered 48 in FIG. 2). It is then bent upwardly around the extreme outer edge of hem 18, as shown at 49, so as to be inside sleeve 14 and adjacent the bottom seam 31 (FIG. 4) of such sleeve.

The hospital corner is sewn, and the flexible electrical conductor 44 is sewn along bottom seam 31 (always by nonconductive thread), reference being made to FIG. 4.

The flexible conductor 44 then bends downwardly around the armpit region (through the armhole) of the garment, and down the side seam 51 of body 10. (It is emphasized that (FIGS. 1 and 3) the body 10 has vertical side seams 51 that extend directly downwardly from the armpit regions of the garment and that meet the bottom seams 31 of the sleeves). Such side seams are sewn.

The flexible electrical conductor 44 is sewn along the side seam 51 of body 10, until an elevation generally the same as the left pocket 33 (upper region thereof) is reached.

A hospital corner is then made on the inside of the garment (FIG. 3), having an angled corner as indicated at 52. The flexible conductor 44 is extended out through the side seam 51 of body 10 (FIG. 3) so as to be on the exterior of the garment. The hospital corner is sewn and the remainder of the flexible conductor 44 is then sewn horizontally along the exterior of body 10 to the vicinity of the outer side of pocket 33 as shown in FIG. 3.

Referring again to FIG. 3, a stud (part of a metal snap connector) 53 is connected to the flexible conductor 44 at a region near the above-mentioned stud (metal snap connector) 32. The distance between connectors 53 and 32 is preferably in the range 1¾ inches and 2.0 inches. At the opposite end of the flexible connector 44, another stud (part of a metal snap connector) 54 is mounted (FIG. 2). Relative to each of the connectors 53, 54, and referring to FIG. 5, there is electrical connection only to the conductive ribbon 42, not to the body 10 of the garment. Thus, as shown in FIG. 5, a portion of the connector 53 extends through the outer side of sheath 43 at an opening therein, and extends through conductive ribbon 42, having a flange 56 at its inner end that bears against the inner surface of conductive ribbon 42, as illustrated.

Stud (connector) 54 (FIG. 2) is mounted and connected and constructed identically to stud 53 (FIG. 5). Thus, FIG. 5 is equally applicable to connectors 53 and 54.

To complete the second grounding path, the second insulated flexible wire 41 (FIG. 1) is snap-connected to connector 54, while an insulated flexible wire 57, that forms the second portion of the dual grounding cord 37, is snap-connected to snap connector 53.

Operation

The described combination garment and wrist strap achieve, in a practical and effective way, the known advantages of dual-path grounding of workers in electronics plants (for example), and achieve the metal-to-skin contact desired by a number of manufacturers. Such metal-skin contact is between plates 25*a* and 25*b* (FIG. 5) and the wrist of the wearer.

Furthermore, the connections between wrist strap 21 and the hem 18 of sleeve 14 are at such locations (connectors 30 and 54) as to provide minimal effect (if any) on the operations of the worker wearing the garment. The connectors 30, 54 are at the top of the sleeve where they are not likely to rub on any supporting surface or any work. Very importantly, the elongate, flexible, washable electrical conductor 44 provides no interference whatever with the operator or worker, either at its exterior portions (at the sleeve end and near pocket 33) or its interior portions (adjacent the seam 31, FIG. 4, on the underside of sleeve 14) or adjacent the side seam 51 (FIG. 3) of body 10.

After the ground cord 37 and the flexible conductors 35, 41 are disconnected from the garment, the garment is easily washable many times over without causing any deterioration of the contact between the worker (especially at metal plates 25*a*, 25*b*) and ground.

There is further achieved the important advantage of having one of the paths be throughout .large portions of the garment, with the described Faraday cage effect, and the other path be isolated or dedicated and insulated from the electrically conductive body and left sleeve of the garment.

In an alternative embodiment, the wires 35, 41 are not employed. Instead, studs 30, 54 (FIG. 2) are mounted on the inside of the hem 18 and are directed inwardly. Furthermore, studs 27, 28 on the wrist strap 21 are both replaced by female connector portions adapted to receive studs 30, 54. The wrist strap 21 is caused to be near or within hem 18, and connector elements 27, 54 and 28, 30 are directly mated with each other. The insulated flexible conductor 44, at its region that is sewn around hem 18 on the outside of the sleeve end, is preferably instead sewn around the inside of the sleeve end; there is then no portion 49 that bends around the sleeve end. Stud 30 is connected directly to the sleeve, while stud 54 is mounted as shown in FIG. 5—insulated from the sleeve and connected to the conductive ribbon. At least in the embodiment described in this paragraph, the female elements replacing 27, 28 are not located as shown in FIG. 1, but instead are both located in a single plane perpendicular to the axis of the wrist band 21 (as shown in schematic FIG. 1).

The foregoing detailed description is to be clearly understood as given by way of illustration and example only, the spirit and scope of this invention being limited solely by the appended claims.

What is claimed is:

1. A multi-path static control apparatus including a garment, comprising:

a smock or shop jacket, said smock having an electrically conductive body, said smock also having at least one sleeve that is electrically conductive, electrical contact means provided at the outer end of said one sleeve to make electrical contact with first and second different regions of the wrist of the wearer, said electrical contact means having first and second parts insulated from each other, means to form a first path to ground from said first region of the wrist of the wearer, said means to form said first path to ground comprising said first part of said electrical contact means, further comprising said one sleeve, further comprising said body, further comprising a first connector element on said body, and further comprising a first ground cord extending to ground from said first connector element, means to form a second path to ground from said second region of the wrist of the wearer, said means to form said second path to ground comprising said second part of said electrical contact means, further comprising a second connector element on said body, further comprises a flexible conductive ribbon extending up said conductive one sleeve to the armpit region of said smock, and extending down said body to said second connector element on said body, and further comprising a second ground cord extending to ground from said second connector element, and means to electrically isolate said conductive ribbon from said one sleeve and from said body, said electrical isolation means comprising an insulating cloth sheath provided on opposite sides of said flexible conductive ribbon, said sheath being secured to said one sleeve and to said body.

2. A multi-path static control garment, comprising:

a smock or shop jacket, said smock having an electrically conductive cloth body, said smock also having at least one cloth sleeve that is electrically conductive, a flexible conductive ribbon, a nonconductive cloth sheath provided around said ribbon, said ribbon and sheath combining with each other to form an insulated flexible conductor, means to mount said insulated flexible conductor along said one sleeve, and past the region where said one sleeve connects to said body, and down at least part of said body, and first and second electrical contact means on said body adapted to be connected to a dual grounding cord, said first contact means being electrically connected to said ribbon and insulated from said body, and said second contact means being electrically connected to said body.

3. The invention as claimed in claim 2, in which the great majority of said insulated flexible conductor is mounted on the inner side of said smock, and in which said insulated flexible conductor extends through an armhole of said smock.

4. The invention as claimed in claim 3, in which said insulated flexible conductor extends through a hole in said body, from the inner side of said body to the outer side thereof.

5. The invention as claimed in claim 4, in which said body has vertical seams, and in which said hole is at one of said seams and is such that said hole is formed between opposed edges of the smock body cloth at part of said one seam.

6. The invention as claimed in claim 5, in which said insulated flexible conductor is bent and sewn in a hospital corner adjacent said hole.

7. The invention as claimed in claim 4, in which one of said contact means on said body is mounted on the outer side of said insulated flexible conductor, at a portion thereof that is on the outer side of said body, said portion having an inner side that engages the outer side of said body.

8. The invention as claimed in claim 4, in which said insulated flexible conductor is bent and sewn in a hospital corner adjacent said hole.

9. The invention as claimed in claim 2, in which said first contact means is a metal stud portion of a metal snap connector, said metal stud portion having a part that extends through the outer sheath portion of said insulated flexible conductor, and also through said ribbon, but does not extend through the inner sheath portion of said insulated flexible conductor.

10. A multi-path static control apparatus including a garment, comprising:

a smock or shop jacket, said smock having an electrically conductive body, said smock also having at least one sleeve that is electrically conductive, a dual contact wrist strap adapted to be mounted on the wrist of the wearer of said smock, adjacent the outer end of said one sleeve, at least one portion of said wrist strap being adapted to electrically contact a first skin region of said wrist, at least one other portion of said wrist strap being adapted to electrically contact a second skin region of said wrist, said one portion of said wrist strap and said other portion thereof being electrically insulated from each other, means to form a first path to ground from said one portion of said wrist strap, said first path to ground comprising said one sleeve and said body, further comprising an electrical connector between said one portion of said wrist strap and said one sleeve, and further comprising a ground cord connected between said body and ground, and means to form a second path to ground from said other portion of said wrist strap, said second path to ground comprising an insulated flexible conductor extended along said one sleeve and having an outer portion near said outer end of said one sleeve, and extended along said body, further comprises a second electrical connector between said other portion of said wrist strap and said outer portion of said insulated flexible conductor on said one sleeve, and further comprises a second ground cord connected between ground and a portion of said insulated flexible conductor located on said body.

11. The invention as claimed in claim 10, in which said insulated flexible conductor comprises a conductive ribbon, and further comprises an insulating cloth sheath mounted on opposite sides of said ribbon in sandwiched relationship.

12. The invention as claimed in claim 11, in which said insulated flexible conductor extends up the interior of said one sleeve, thence through the armhole where said one sleeve connects to said body, and thence through the interior of a part of said body.

13. The invention as claimed in claim 11, in which the underside of said one sleeve has a seam therealong, and in which said insulated flexible conductor extends along said seam.

14. The invention as claimed in claim 13, in Which said first-mentioned electrical connector and said second electrical connector are located on the upper side of said one sleeve.

15. The invention as claimed in claim 11, in which a portion of said insulated flexible conductor at the outer end of said one sleeve reverse-bends around the extreme outer end of said one sleeve, and bends in a hospital corner and extends along said extreme outer end.

16. The invention as claimed in claim 11, in which said first-mentioned electrical connector and said second electrical connector are located on the upper side of said one sleeve.

17. The invention as claimed in claim 10, in which said first-mentioned electrical connector and said second electrical connector are located on the upper side of said one sleeve, in which said insulated flexible conductor extends along the lower side of said one sleeve to the armpit region of the smock, in which said insulated flexible conductor extends downwardly from said armpit region along a side of said body, and in which said insulated flexible conductor has a portion extending around the cuff of said one sleeve from said upper side to said lower side.

18. The invention as claimed in claim 17, in which said insulated flexible conductor comprises an insulating cloth sheath sewn to said one and to said body.

19. The invention as claimed in claim 10, in which said insulated flexible conductor comprises an insulating cloth sheath sewn to said one and to said body.

20. The invention as claimed in claim 19, in which there are two hospital corners in said insulated flexible conductor, in which the portions of said insulated flexible conductor that extend along said one sleeve and along said body are within said sleeve and said body and sewn thereto, and in which part of said insulated flexible conductor is outside said body and sewn thereto and extends through a hole in said body, and in which another part of said insulated flexible conductor is outside the hem of said one sleeve and sewn thereto, and reverse-bends around the extreme end of said one sleeve.

* * * * *

UNITED STATES PATENT AND TRADEMARK OFFICE

CERTIFICATE OF CORRECTION

PATENT NO. : 5,548,469

DATED : August 20, 1996

INVENTOR(S) : Kay L. Adams

It is certified that error appears in the above-indentified patent and that said Letters Patent is hereby corrected as shown below:

Claim 18 (Column 8, line 49), following the word "one" insert ---sleeve---.

Claim 19 (Column 8, line 52), following the word "one" insert ---sleeve---.

Signed and Sealed this

Twentieth Day of May, 1997

*Attest:*

Bruce Lehman

BRUCE LEHMAN

*Attesting Officer*

*Commissioner of Patents and Trademarks*